US008020671B2

(12) United States Patent
Kocher et al.

(10) Patent No.: US 8,020,671 B2
(45) Date of Patent: Sep. 20, 2011

(54) ELEVATOR INSTALLATION, A GUIDE RAIL OF AN ELEVATOR INSTALLATION, BRAKE EQUIPMENT OF AN ELEVATOR INSTALLATION AND A METHOD FOR GUIDING, HOLDING AND BRAKING AN ELEVATOR INSTALLATION

(75) Inventors: Hans Kocher, Udligenswil (CH); Josef A. Muff, Hildisrieden (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 11/946,326

(22) Filed: Nov. 28, 2007

(65) Prior Publication Data

US 2008/0135345 A1 Jun. 12, 2008

(30) Foreign Application Priority Data

Dec. 7, 2006 (EP) ..... 06125624

(51) Int. Cl.
*B66B 5/16* (2006.01)
*B66B 7/02* (2006.01)
*B61B 3/00* (2006.01)
*B61H 7/00* (2006.01)

(52) U.S. Cl. ..... 187/351; 187/370; 187/375; 187/406; 104/127; 188/41; 188/43; 188/189

(58) Field of Classification Search ..... 187/364, 187/406, 370, 371, 372, 409, 411, 351, 373, 187/375, 376; 104/124, 125, 126, 127, 128, 104/202, 212; 188/41–43, 167, 170, 171, 188/184, 189; *B66B 5/16, 7/02*
See application file for complete search history.

(56) References Cited

U.S. PATENT DOCUMENTS

| | | | | | |
|---|---|---|---|---|---|
| 2,877,716 | A * | 3/1959 | Ryznar | 104/306 |
| 3,633,710 | A * | 1/1972 | Preinfalk | 188/62 |
| 3,952,839 | A * | 4/1976 | Brown et al. | 188/62 |
| 4,267,902 | A * | 5/1981 | Schupbach et al. | 188/62 |
| 5,244,746 | A * | 9/1993 | Matsui et al. | 428/609 |
| 5,351,516 | A * | 10/1994 | Bialy | 72/199 |
| 5,503,257 | A * | 4/1996 | Sugita et al. | 188/251 R |
| 6,006,867 | A * | 12/1999 | Richter et al. | 187/410 |
| 6,196,359 | B1 * | 3/2001 | Daudi | 188/72.5 |
| 6,371,261 | B1 * | 4/2002 | Thompson et al. | 188/250 G |
| 6,802,402 | B2 * | 10/2004 | Bausch et al. | 188/171 |
| 2003/0079640 | A1 * | 5/2003 | Beatson et al. | 104/106 |
| 2003/0085078 | A1 * | 5/2003 | Simmonds et al. | 187/373 |

(Continued)

FOREIGN PATENT DOCUMENTS

EP 0 856 485 A1 8/1981

(Continued)

*Primary Examiner* — Michael Mansen
*Assistant Examiner* — Stefan Kruer
(74) *Attorney, Agent, or Firm* — Fraser Clemens Martin & Miller LLC; William J. Clemens

(57) ABSTRACT

An elevator installation includes a guide rail and brake equipment for guiding, holding and braking the elevator installation. The brake equipment has a brake lining which co-operates with a brake surface, advantageously with the brake surface of the guide rail, for the purpose of the braking and holding. The brake surface has at least one longitudinal wedge groove or wedge elevation which is oriented in the braking direction and on which the brake lining acts in case of need. An amplification of the braking force is achieved by the longitudinal wedge groove or wedge elevation.

15 Claims, 7 Drawing Sheets

U.S. PATENT DOCUMENTS

| | | | | |
|---|---|---|---|---|
| 2006/0060428 | A1 * | 3/2006 | Hashiguchi | 187/254 |
| 2007/0107993 | A1 * | 5/2007 | Miller et al. | 187/406 |

FOREIGN PATENT DOCUMENTS

| | | | | |
|---|---|---|---|---|
| EP | 0 774 439 | A | | 5/1997 |
| EP | 0 856 485 | A1 | | 8/1998 |
| EP | 1 213 249 | A | | 6/2002 |
| GB | 191202840 | A | | 0/1912 |
| JP | 06 199483 | A | | 7/1994 |
| JP | 06340390 | A | * | 12/1994 |
| JP | 07054845 | A | * | 2/1995 |
| JP | 2005001800 | A | * | 1/2005 |
| WO | WO 2005063065 | A1 | * | 7/2005 |

* cited by examiner

ELEVATOR INSTALLATION, A GUIDE RAIL OF AN ELEVATOR INSTALLATION, BRAKE EQUIPMENT OF AN ELEVATOR INSTALLATION AND A METHOD FOR GUIDING, HOLDING AND BRAKING AN ELEVATOR INSTALLATION

FIELD OF THE INVENTION

The present invention relates to an elevator installation, to a guide rail of an elevator installation, to brake equipment of an elevator installation and to a method for guiding, holding and braking an elevator installation.

BACKGROUND OF THE INVENTION

An elevator installation substantially serves for vertical transport of goods or persons. The elevator installation includes for this purpose an elevator car for reception of the goods or persons, which elevator car is movable along a guide path. As a rule, the elevator installation is installed in a building and the elevator car transports goods or persons from and to various floors of this building. In a customary construction the elevator car is installed in a shaft of the building and it contains, apart from the car, support means which connect the car with the counterweight. The elevator car is moved by means of a drive, which acts selectably on the support means or directly on the elevator car or the counterweight. The guide path for guidance of the elevator car is usually a guide rail which is fixedly arranged in the building or in the shaft. From time to time an elevator installation of that kind is also arranged outside a building, wherein then the guide path can be part of a structure. Elevator installations of that kind are equipped with brake systems which on the one hand can hold the elevator car in a stopping position and/or can brake and hold the elevator car in the event of a fault.

An elevator installation with brake equipment is known from patent document EP 1 213 249, in which holding and braking is achieved in that a brake part is brought into mechanically positive contact with a stationary part. The brake part is for that purpose pressed against the stationary part by a small force. In this connection a defined sliding movement, which enables braking, is brought about at the brake part. The brake equipment requires, in particular, low brake actuating forces and thus also low brake release forces.

The problem with this solution is now to be seen in the fact that the brake equipment has to include sliding equipment so as to make possible, in the case of braking, a gentle stopping of the elevator car. This requires, above all in the case of higher speeds, long slide paths and associated elements defining braking force, such as, for example, springs. This necessitates much constructional space and is expensive.

SUMMARY OF THE INVENTION

The present invention is based on the object of providing brake equipment of an elevator installation which can hold an elevator car in an elevator installation at standstill with low actuating forces, but in the case of emergency is also in a position of braking the elevator car. In addition, it shall demand little constructional space.

The elevator installation according to the present invention comprises an elevator car and brake equipment for braking and holding the elevator car. The brake equipment comprises a brake lining which co-operates with a brake surface for the purpose of the holding and braking.

Moreover, the present invention relates to a guide rail of an elevator installation. The brake rail brakes and holds the elevator car by means of brake equipment. In that case the brake rail has a brake region as a brake surface for interaction with the brake equipment.

Equally, the present invention relates to a method for guiding, holding and braking the corresponding elevator installation.

According to the present invention the brake surface has at least one longitudinal wedge groove or wedge elevation which is oriented in braking direction and on which the brake lining acts in case of need. This longitudinal wedge groove or longitudinal wedge elevation can be a groove or elevation of appropriate width or several wedge grooves can lie adjacent to one another. The advantage of this construction is to be seen in that the wedge groove shape effects an amplification of a normal force and that with this normal force a high braking force can thus be achieved, wherein a possibility of sliding is additionally given.

The normal force $F_N$ is that force which presses the brake lining towards the planar brake surface in the case of need. The planar brake surface is oriented perpendicularly (90°) relative to the normal force $F_N$. This normal force $F_N$ produces a braking force $F_B$ which is defined by the coefficient of friction $\mu$ between brake lining and brake surface:

$$F_B = F_N \times \mu$$

If the brake equipment in relation to the brake surface is disposed at standstill, a coefficient of static friction $\mu_H$ is to be used as the coefficient of friction $\mu$ and in the case of a relative movement between brake equipment and brake surface a coefficient of sliding friction $\mu_G$ is used. A braking force amplification in correspondence with a wedge plane form results with use of a wedge groove. In the case of a wedge plane inclination in correspondence with an angle $\alpha$, wherein the angle $\alpha$ denotes the plane deviation of the wedge plane from the planar brake surface, a braking force amplification of $1/\cos\alpha$ results. The resulting braking force $F_{BK}$ is:

$$F_{BK} = (1/\cos\alpha) \times F_N \times \mu$$

A significant amplification of braking force can thus be achieved by means of the longitudinal wedge groove or wedge elevation. It is clear that as a rule there is selection of a symmetrical wedge shape so that lateral forces mutually cancel.

Advantageously, the brake lining has a counter-shape adapted to the longitudinal wedge groove or wedge elevation of the brake surface. Wear of the brake lining can thereby be kept small, since the wedge surfaces rest or rub on one another. Obviously it is to be ensured that in the case of wear the brake lining can be appropriately urged forward. In this connection it is to be noted that current items of brake equipment are increasingly employed for sole holding of the elevator car at a floor. This holding force $F_H$ results from, for example, a maximum load difference between car and counterweight. In inversion of the above-mentioned formula for calculation of the braking force, there accordingly results a required normal force $F_{NH}$ for holding a car at a floor of:

$$F_{NH} = F_H \times \cos\alpha / \mu_H$$

Analogously, a required normal force $F_{NB}$ for braking a car results:

$$F_{NB} = F_B \times \cos\alpha / \mu_G$$

In this connection, the required braking force $F_B$ is used instead of the holding force $F_H$ and the coefficient of sliding friction $\mu_G$ is used instead of the coefficient of static friction $\mu_H$.

A pressing device for holding and braking the car can be designed, in correspondence with the wedge angle $\alpha$, with lower pressing forces $F_N$. This enables use of smaller drive units or brake release units, which is correspondingly more favorable.

Advantageously, in the design of the brake equipment the number of brake linings and/or items of brake equipment which co-operate is to be taken into consideration.

In a preferred embodiment the brake equipment is arranged in the region of the elevator car and the brake surface is integrated in a guide rail, which guide rail at the same time guides the elevator car. Advantageously at least one brake equipment is used per guide rail. This is advantageous, since the car can thereby be directly held at a stop. Stretchings of support means thereby do not influence a loading or unloading process.

A further advantage of this solution according to the present invention is to be seen in that the brake lining and thus the brake equipment is at the same time laterally guided by the longitudinal grooves. Derailing of the braking lining and thus failure of the braking action are effectively prevented.

An embodiment in which the guide rail has a guide region for interaction with the guide means and a brake region as brake surface for interaction with the brake equipment is particularly advantageous, wherein the guide region and brake region have different surfaces and the guide region is geometrically separated from the brake region. This embodiment allows an optimum and functionally appropriate design of the respective regions.

Advantageously the guide rail is a T-shaped guide rail, which has a rail web, and this rail web has both the guide region for interaction with the guide means and the brake region for interaction with the brake equipment. Other forms of brake rails are obviously also possible, such as, for example, guide rails in the form of an angle profile member or any other shapes. T-shaped guide rails are widely known in elevator construction and manufacture thereof is possible in simple manner.

In an embodiment of particularly elevated quality the guide region is provided with a slide means for reducing friction or it is furnished with a slide coating, wherein the slide coating is a profile member, preferably a synthetic material profile member which contains "Teflon" (registered trademark of E. I. Du Pont de Nemours and Company, Wilmington, Del.) and which, for example, is plugged onto the relevant web of the guide rail.

Nano-composites, for example homogeneously formed nickel-fluorpolymer coatings, are, for example, also particularly suitable as the slide means coating, since they enable unchanging slide characteristics in conjunction with good chemical and mechanical properties. This construction enables provision of a guide rail which does justice to high demands on comfort.

The brake region can be formed directly in the basic structure of the brake track. The brake track or the corresponding guide rail is, for example, drawn, rolled or mechanically processed. Alternatively, the brake region can also be produced by means of a brake profile member mounted on the basic structure of the guide rail. The brake region can obviously be provided with a friction-influencing means, for example nano-composite, or with a surface structure for increasing friction. An advantage of this embodiment is that a coefficient of friction can be selected to be as high as possible, whereby the required normal force is in turn reduced. This makes possible creation of economical brake equipment.

In an advantageous embodiment the separation between the guide region and the brake region is constructed in such a manner that a transmission of lubricants such as, for example, oil or other slide means from the guide region to the brake region is prevented or reduced. A functional reliability of the brake equipment is thereby significantly increased, since no substances which reduce the coefficient of friction can easily pass into the brake region.

In an alternative embodiment the brake equipment is arranged in the region of a drive motor and the brake surface is disposed in direct connection with a drive pulley or a drive shaft of the drive motor. In this connection the braking and holding action of the brake equipment is transmitted to the elevator car by way of supporting and drive means. A holding brake in the drive can thereby be provided economically, since as a consequence of the wedge action a reduced braking force is possible.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
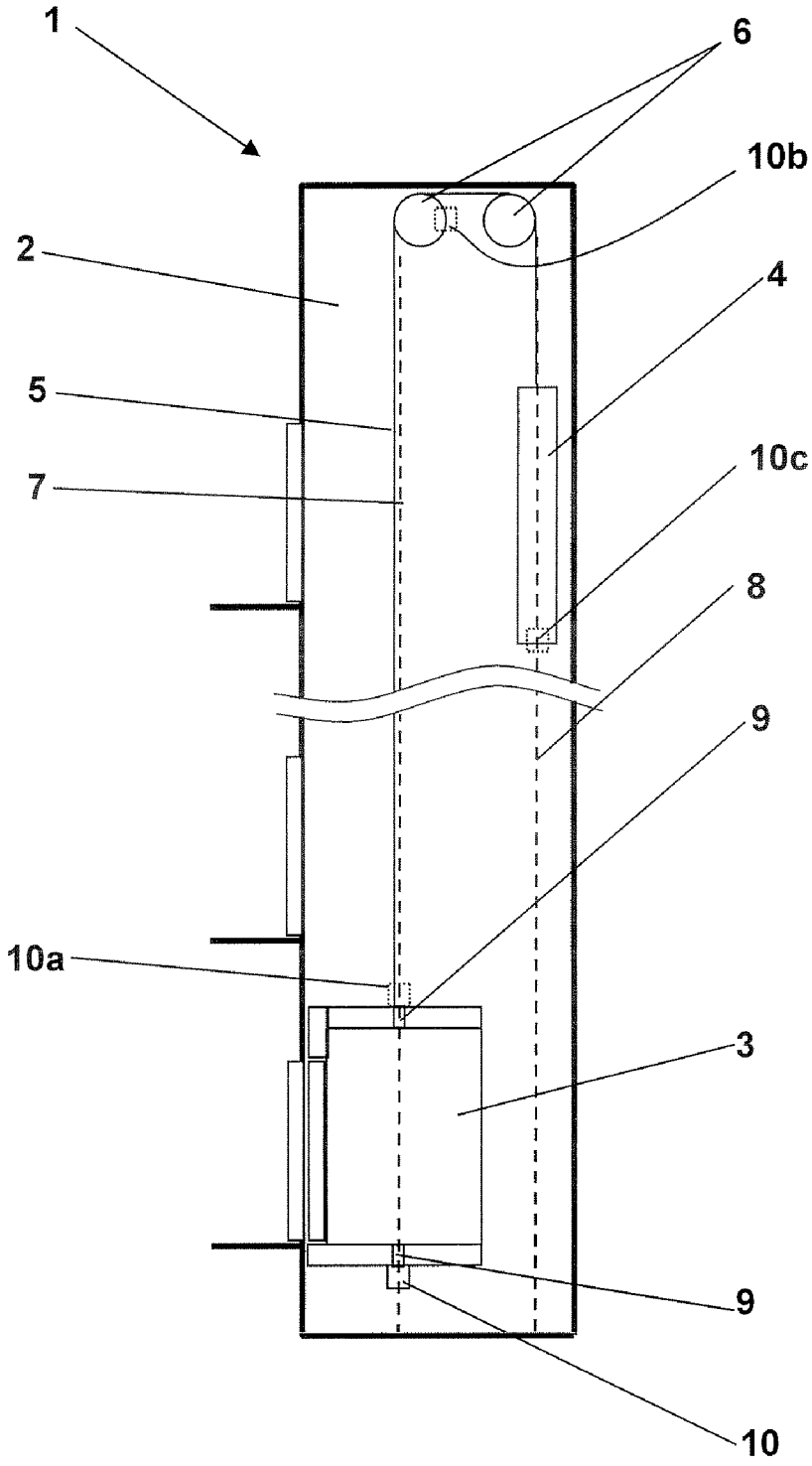
FIG. 1 is a schematic view of an elevator installation according to the present invention.

One possible overall arrangement of an elevator installation is illustrated in FIG. 1. The elevator installation 1 consists of an elevator car 3 for reception of goods or persons. The car is arranged to be movable along a guide path or by guide rails 7. The elevator installation 1 is installed in a shaft 2 of a building. The elevator car is connected with a counterweight 4 by way of supporting and drive means 5. The car 3 is moved in opposite sense to the counterweight 4 by means of a drive 6, which in the illustrated example acts on the support means 5. The guide rails 7 for guidance of the car, as well as guide rails 8 for guidance of the counterweight 4, are fixedly arranged in the building or in the shaft 2. The car 3 is guided by means of guide shoes or guide rollers 9 along the guide rails 7. The elevator car 3 is equipped with items of brake equipment 10, which on the one hand hold the elevator car 3 in a holding position and/or can brake and hold the elevator car 3 in a fault case.

In the illustrated example the items of brake equipment 10 are arranged below the car 3. An attachment 10*a* above the car 3 is obviously also possible, as optionally illustrated in FIG. 1, or the brake equipment 10 can in accordance with the respective requirement be arranged at the drive 6, 10*b*, at the counterweight 4, 10*c* or at a deflecting roller (not shown).

Figure 2:
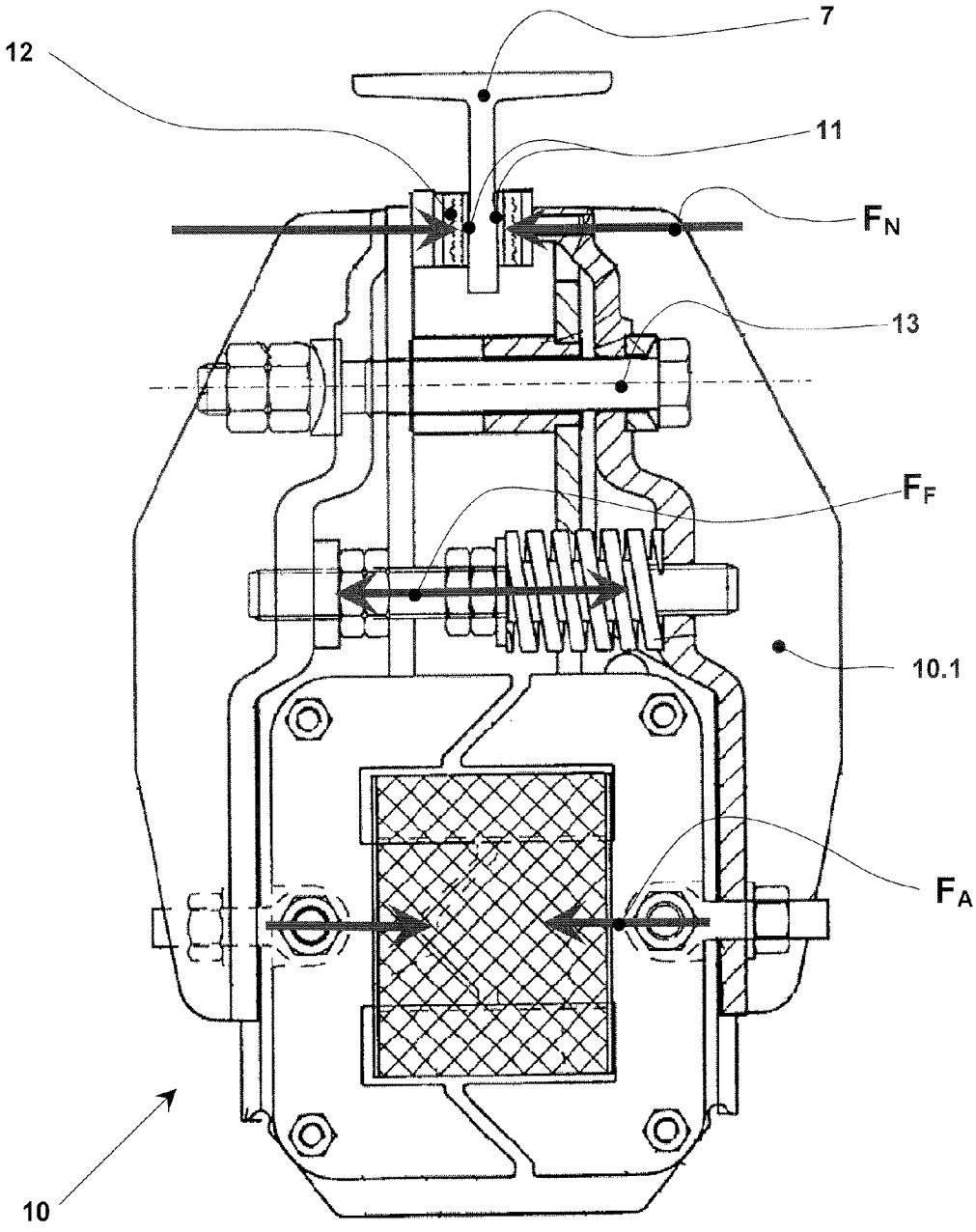
FIG. 2 is a plan view of a known brake equipment with a guide rail according to the present invention.

FIG. 2 shows an example of embodiment of known brake equipment 10. The brake equipment comprises two brake levers 10.1 which are mounted substantially at one axis 13. Brake linings 12 are arranged at front ends of the brake levers 10.1. The brake levers 10.1 are urged apart by a spring force $F_F$. Due to the mounting of the brake levers 10.1 at the axis 13, front ends of the brake levers 10.1 with the brake linings 12 are pressed, in correspondence with the lever dimensions, by a pressing force $F_N$ against brake surfaces 11 of the guide rail 7. A resultant friction force or holding force $F_H$ or braking force $F_B$ thereby results at the brake surface 11. The resultant friction force is in that case equal to the pressing force $F_N$ multiplied by the number of brake surfaces (in the illustrated example two brake surfaces) and a coefficient of friction μ. The coefficient of friction μ in that case corresponds, in the holding state, with a coefficient of static friction AH and in a braking state with a coefficient of sliding friction $\mu_G$.

The holding force is thus calculated as: $F_H=F_N\times 2\times\mu_H$ [1]

The braking force is correspondingly calculated as:

$F_B=F_N\times 2\times\mu_G$ [2]

For release of the brake equipment 10, i.e. when the car 3 is to be moved, the brake levers 10.1 are drawn together at the rearward ends thereof by means of an actuator force $F_A$, whereby the brake linings 12 are relieved and a braking or holding force thereby removed.

Figure 3:
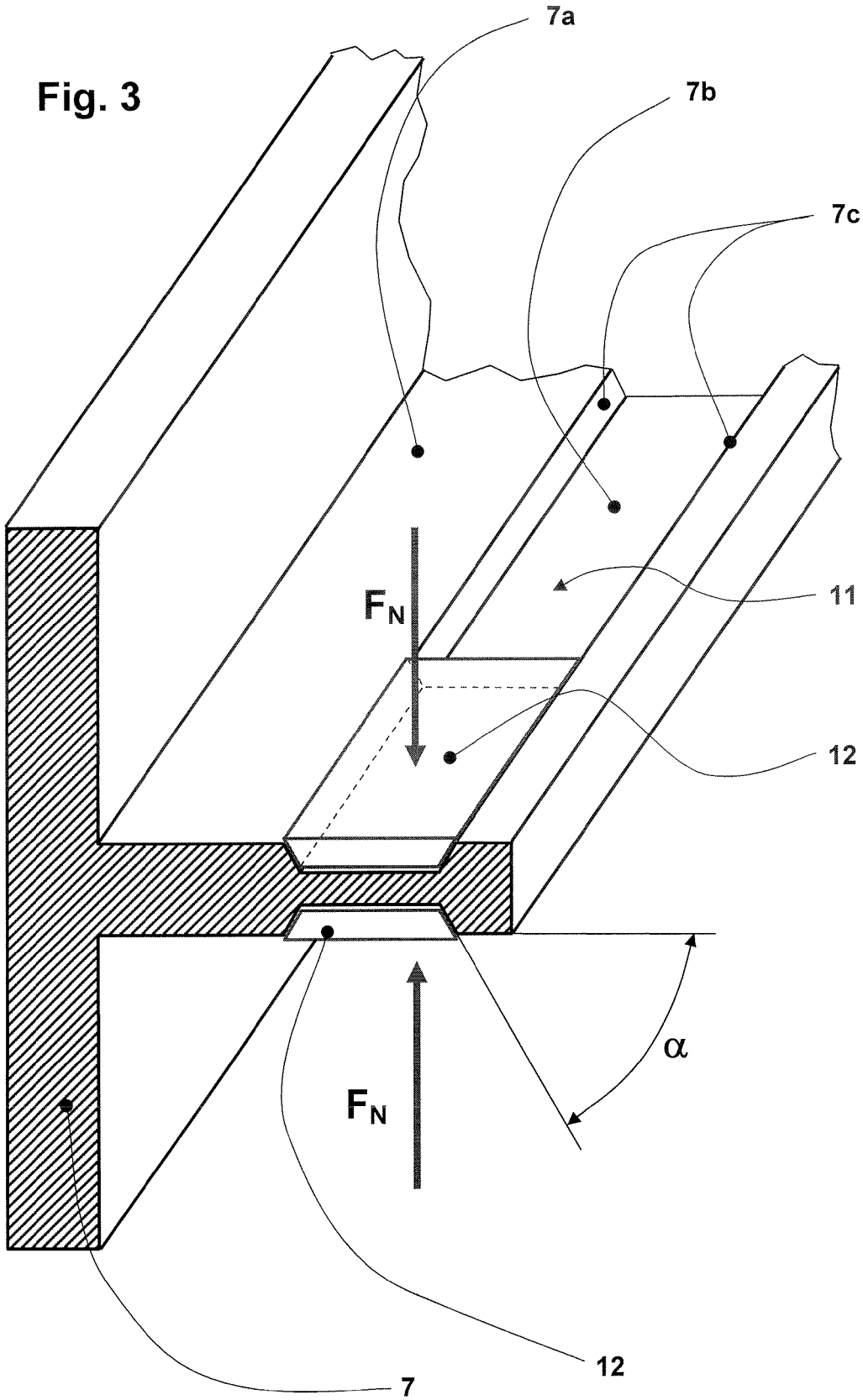
FIG. 3 is a schematic view of a guide rail with an integrated brake track according to the present invention.

FIG. 3 shows a guide rail 7 as it is constructed for co-operation with the brake equipment 10. The guide rail is realized in the form of a T-profile member. The guide rail 7 has a rail web 7*a* in which the brake surface 11 is worked in the form of a longitudinal wedge groove. The longitudinal wedge groove is, in the illustrated example, worked in at a front side and rear side of the web 7*a*. The longitudinal wedge groove has two lateral flanks 7*c* which are inclined relative to the web main surface 7*a* in correspondence with an angle ox. The lateral flanks 7*c* are provided for co-operation with the brake lining 12, which has the equally inclined lateral flanks or the adapted counter-shape. The lateral flanks of the brake lining 12 and/or the lateral flanks 7*c* of the longitudinal wedge groove are, if required, provided with coatings influencing the coefficient of friction. These can be ceramic layers, it can be a specially roughened surface, or nano-composites can be applied for increasing friction. The brake lining 12 is pressed by the pressing force $F_N$ into the longitudinal wedge groove for the purpose of braking, for example with the brake equipment as illustrated in FIG. 2. The wedge base 7*b* has in that case a sufficient play relative to the brake lining 12 in order to absorb any wear of the lateral flanks. The pressing force in that case acts in perpendicular direction (90°) relative to the web surface 7*a*.

Figure 5:
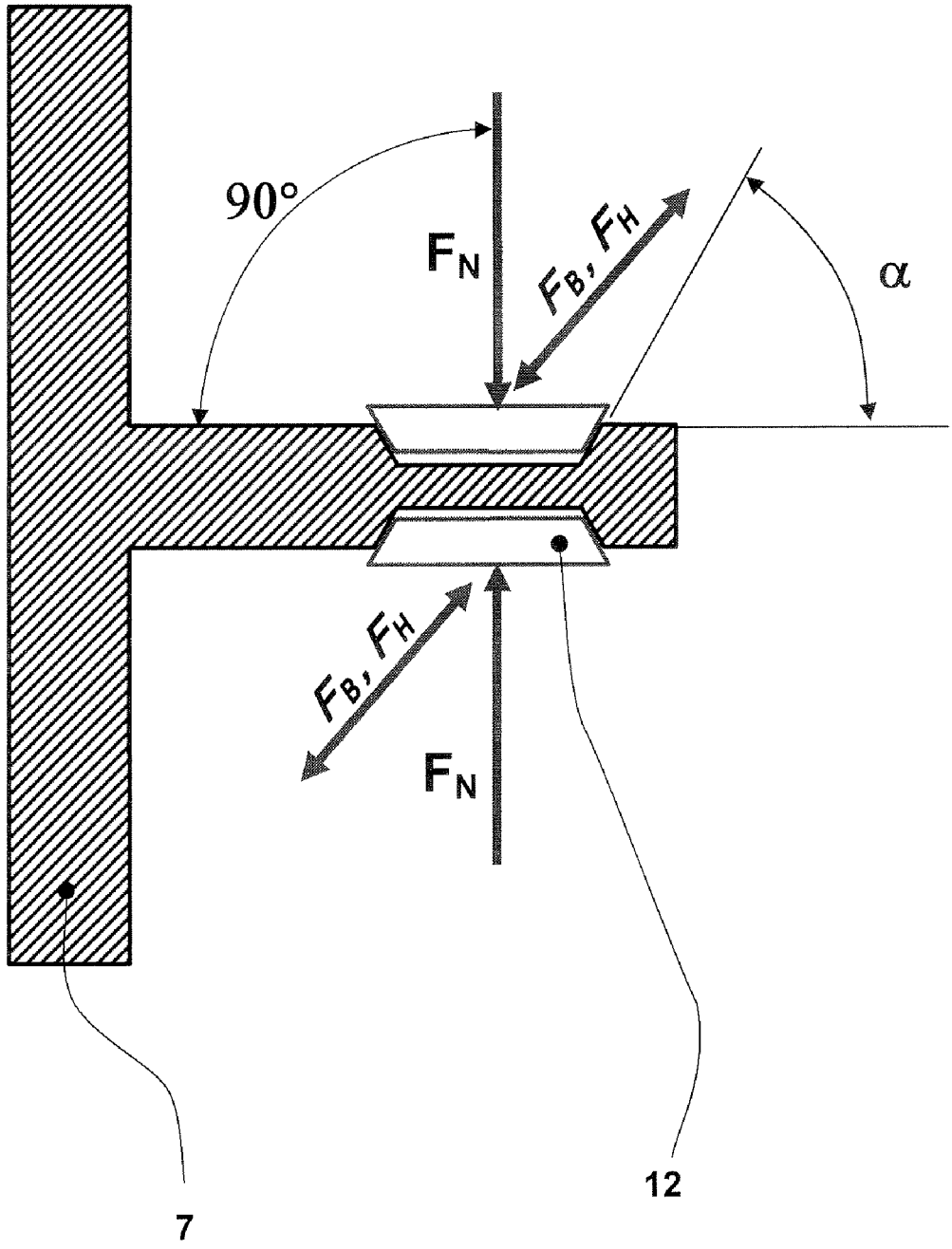
FIG. 5 is a diagrammatic view of a wedge groove formed in a guide rail according to the present invention.

As schematically illustrated in FIG. 5, a resultant braking force $F_B$ or holding force $F_H$ results, with consideration of the wedge angle α, of:

holding force: $F_H=(1/\cos\alpha)\times F_N\times 2\times\mu_H$ [1.1]

braking force: $F_B=(1/\cos\alpha)\times F_N\times 2\times\mu_G$ [2.1]

This holding or braking force in turn relates to brake equipment 10 with two brake surfaces 11 as illustrated in principle in FIG. 1, wherein a brake surface 11 with the corresponding brake lining 12 is present on either side of the rail web 7*a*. The direction of action of the braking or holding force in this connection results from a movement direction or force traction direction acting on the brake equipment.

The following table gives an overview of achievable braking force amplification in dependence on the selected wedge angle α:

| Wedge angle α | Resulting braking force amplification |
|---|---|
| 30° | +15% |
| 45° | +41% |
| 60° | +100% |
| 75° | +285% |

In the case of use of a wedge angle α of 30° a braking force amplification of approximately 15% or an amplification factor of 1.15 thus results. With consideration of the resulting braking force amplification and the loading, which increases therewith, of the brake linings 12, a proposed optimum wedge angle α in the region of 30° to 60° results.

A correspondingly reduced pressing force $F_N$ can also now be selected for achieving a desired holding force, which in turn enables use of brake equipment 10 with small actuator forces. A longitudinal wedge groove further has the advantage that the brake lining 12 is laterally guided. Derailing of the brake lining 12 is thereby prevented. It is obviously conceivable to provide a longitudinal wedge groove primarily for the purpose of lateral guidance. In this connection, longitudinal grooves of other shapes, such as, for example, a curved groove could be used or also flat wedge angles in an angular range below 30° could also be used. In addition, these grooves produce, in correspondence with the above embodiments, as before an amplification of the resulting braking force.

Figure 4:
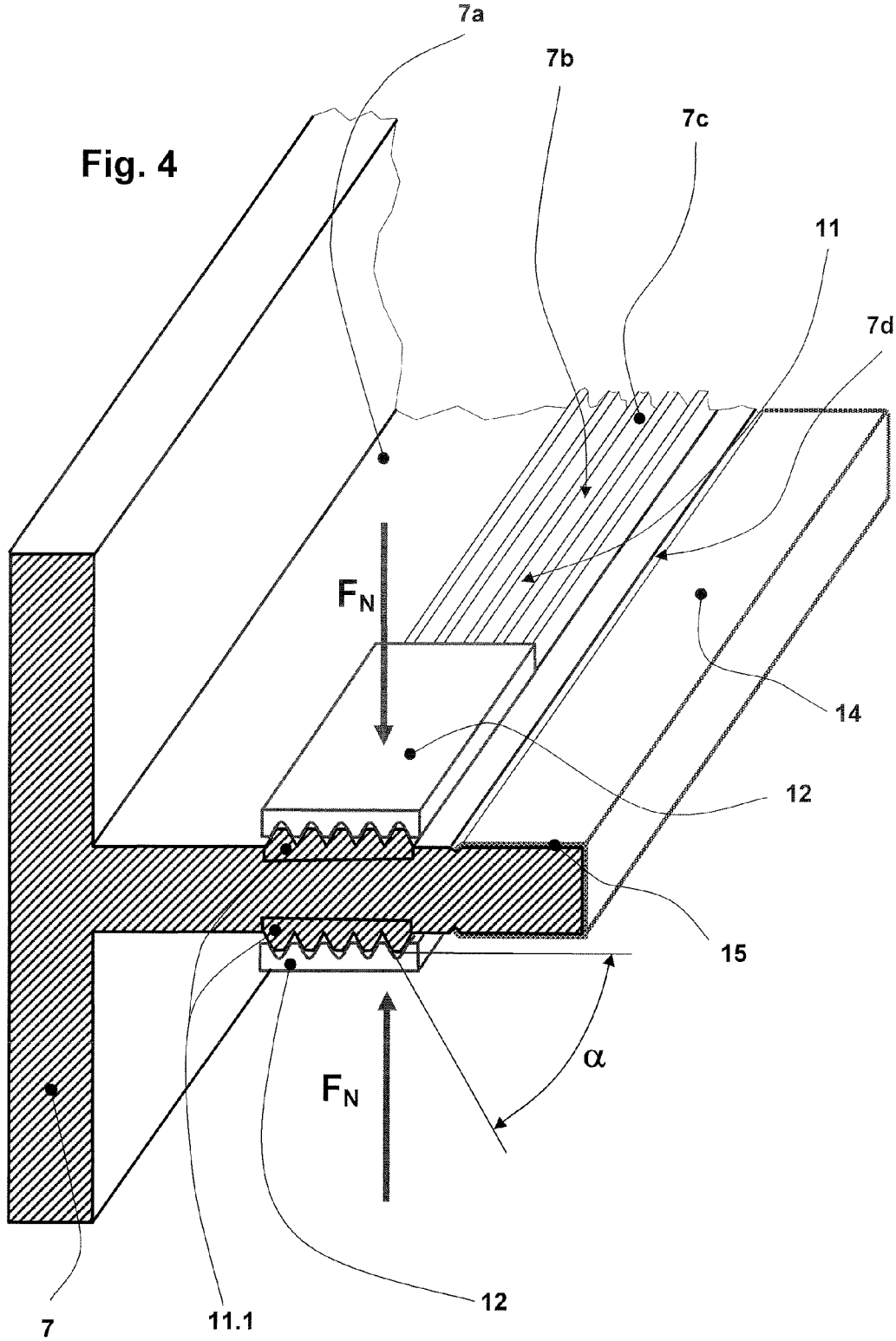
FIG. 4 is a schematic view of an alternative guide rail with an integrated brake track and a separate guide region according to the present invention.

FIG. 4 shows a further guide rail 7 as can be constructed for co-operation with brake equipment 10. This guide rail is also realized in the form of a T-profile member. The guide rail 7 has a rail web 7*a* in which the brake surface 11 in the form of several parallelly extending longitudinal wedge grooves is worked. A rail of that kind can, for example, be easily produced by a drawing process or the longitudinal wedge grooves can be worked, as illustrated by way of example in FIG. 4, into a basic carrier 11.1 which is inserted as a whole into the rail web 7*a* as a longitudinal wedge elevation. In this example as well the wedge flanks 7*c* are arranged in correspondence with a wedge angle α and a brake lining 12 co-operates with these wedge grooves. The calculation of the holding or braking forces takes place as illustrated in the formulae [1.1, 2.1] and the resulting braking force amplification results as in the tables explained with respect to FIG. 5. This multiple groove shape has the advantage that the flank area is significantly increased by comparison with the previous example and that wear is thereby reduced. The guide rail 7 illustrated in this example has separate brake regions or brake surfaces 11 and guide regions 14. The brake region 11 serves, as already explained, for holding or braking the car and the guide region 14 serves for guiding the car 3 by means of guide shoes or guide rollers 9 (FIG. 1). In the example according to FIG. 4 the brake region 11 is separated from the guide region by means of a groove 7*d*. This makes it possible to prevent flowing into the brake region 11 of, for example, an oil film applied to the guide surface 14 for reducing guide resistance. Moreover, the guide region 14 can be provided with other measures reducing slide resistance or noise. Thus, a special slide film or slide lining 15, for example of a "Teflon"-coated synthetic material profile member, can be mounted or the surface of the guide region can be treated with, for example, nano-composites for reducing friction.

Figure 3A:
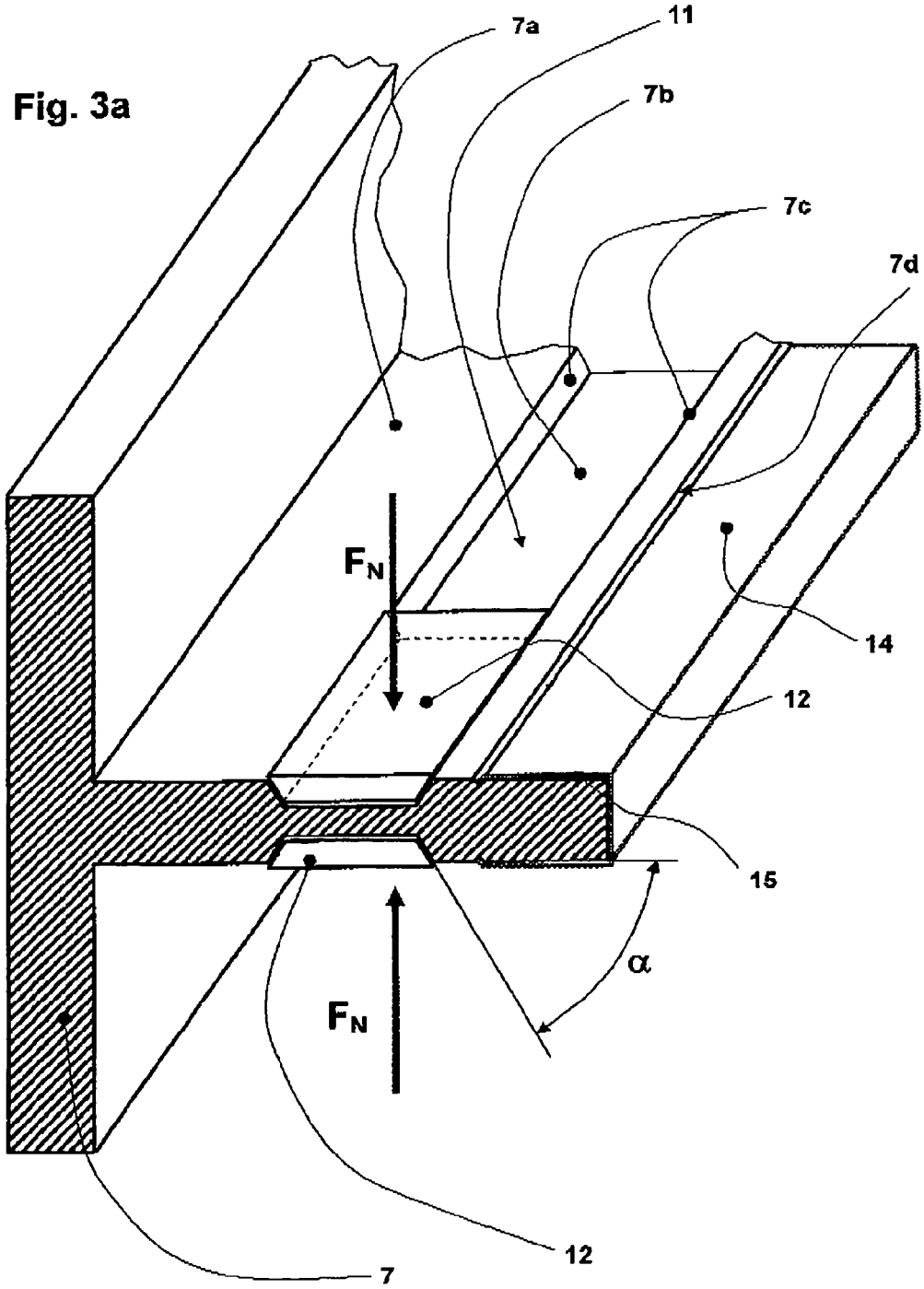
FIG. 3*a* is a view similar to FIG. 3 with the groove 7*d* of FIG. 4 added.

The solutions shown by way of FIGS. 3 and 4 can be combined. FIG. 3*a* shows the guide rail 7 with the groove 7*d* of FIG. 4 added to separate the brake surface 11 from the guide region 14.

The wedge grooves can obviously be arranged to be protruding or deepened or the web 7*a* can be arranged at a guide rail of any shape. In addition, the illustrated solutions for separation of guide region and brake region are usable as desired.

Figure 6:
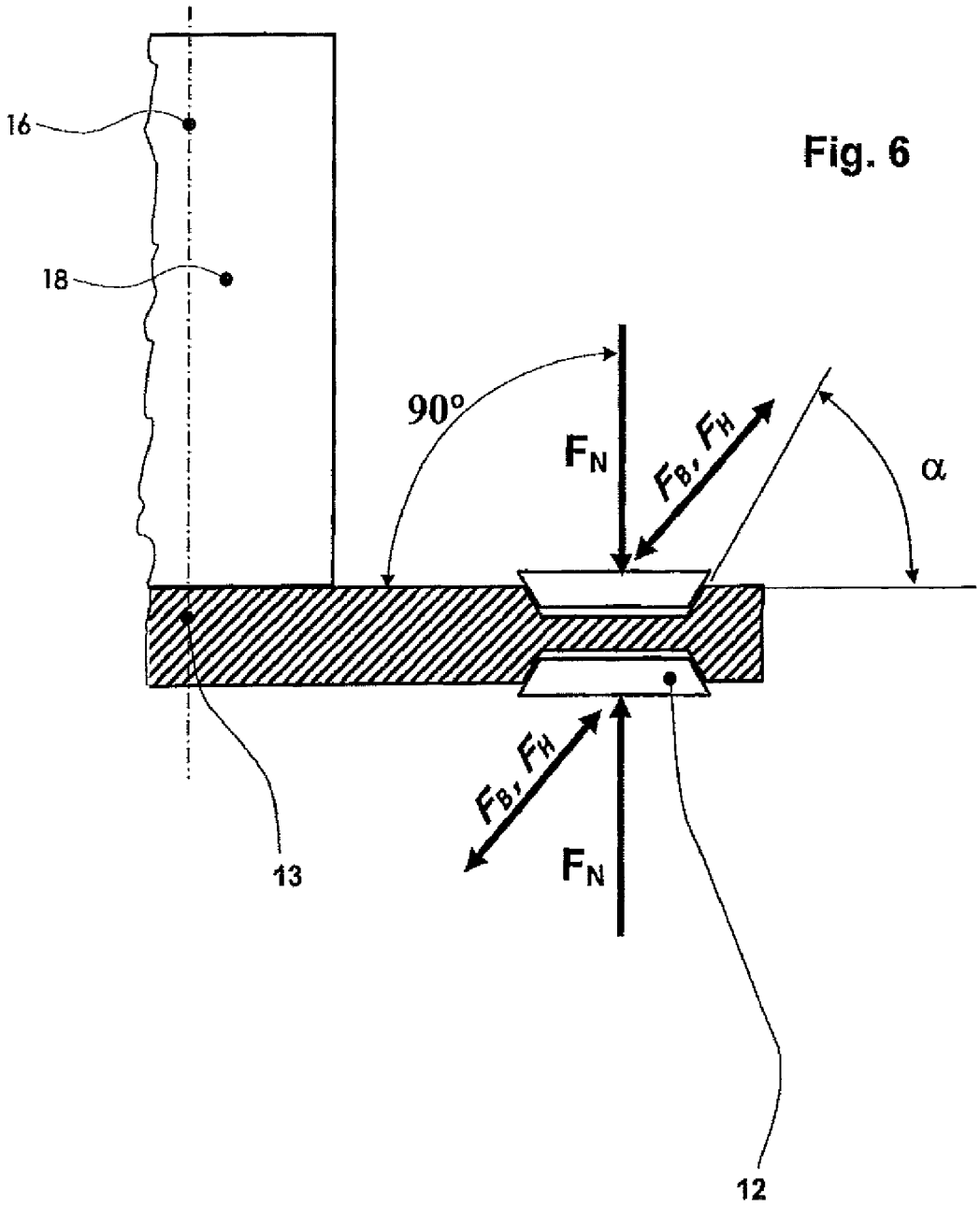
FIG. 6 is a diagrammatic view of a wedge groove formed in a brake device according to the present invention.

The illustrated solutions are obviously also translatable to counterweight guide rails or to a brake disc of the drive and the production methods of the longitudinal wedge grooves are selected by the web manufacturer. In all cases, the brake lining 12 cooperates with at least one longitudinal wedge groove formed in the brake surface of a brake device and oriented in a braking direction. The brake device can be the guide rail 7, as shown in FIG. 4, or, as shown in FIG. 6, a brake device 13 such as a drive pulley, a deflecting pulley or a brake disc. In FIG. 6 an axis of rotation 16 is indicated by an interrupted line, and the structure of the drive pulley, the deflecting pulley, or the brake disc continues to the left of the axis of rotation 16 as a mirror image. A hub 18 of the drive pulley, the deflecting pulley or the brake disc is also shown in schematic form as a non-shaded rectangular element. This and other general structure of the drive pulley, the deflecting pulley and the brake disc are well known to one of ordinary skill in the art.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator installation comprising:

an elevator car;

a brake device having a main surface with an integrated brake surface formed therein, the integrated brake surface shaped as at least one longitudinal wedge groove extending along a braking direction, the at least one longitudinal wedge groove having a pair of lateral flanks that are inclined relative to the main surface at a wedge angle $\alpha$less than 90°; and a brake equipment for braking and holding said elevator car, said brake equipment having a brake lining which selectively co-operates with said brake device for the braking and holding of said elevator car, said brake equipment including a pair of brake levers configured to selectively apply a pressing force $F_N$ to the integrated braking surface of said brake device, the brake lining arranged on a front end of one of the brake levers, the brake lining having a counter-shape corresponding to the shape of the integrated brake surface, and the brake lining acting on the integrated brake surface for braking and holding said elevator car when selectively applied by said one brake lever, wherein said brake equipment is arranged at said elevator car, said brake device includes a guide rail that guides said elevator car, and said brake surface is integrated in said guide rail.

2. The elevator installation according to claim 1 wherein said guide rail has a guide region for interaction with guide means and a brake region with said brake surface for interaction with said brake equipment, wherein said guide region and said brake region have different surfaces and said guide region is separated from said brake region.

3. The elevator installation according to claim 2 wherein said guide rail is T-shaped and has a rail web, said rail web including both said guide region for interaction with the guide means and said brake region for interaction with said brake equipment.

4. The elevator installation according to claim 2 wherein said guide region has a slide means for reducing friction.

5. The elevator installation according to claim 4 wherein said slide means is formed from a nano-composite material for reducing friction.

6. The elevator installation according to claim 4 wherein said slide means includes a profile member formed from a synthetic material for reducing friction.

7. The elevator installation according to claim 1 wherein said at least one longitudinal wedge groove is one of a plurality of V-grooves.

8. The elevator installation according to claim 1 wherein said brake surface is recessed in said brake device or wherein said brake surface protrudes from said brake device.

9. An elevator installation comprising:

an elevator car;

a brake device having a main surface with an integrated brake surface formed therein, the integrated brake surface shaped as at least one longitudinal wedge groove extending along a braking direction, the at least one longitudinal wedge groove having a pair of lateral flanks that are inclined relative to the main surface at a wedge angle $\alpha$; and a brake equipment for braking and holding said elevator car, said brake equipment having a brake lining which selectively co-operates with said brake device for the braking and holding of said elevator car, said brake equipment including a pair of brake levers configured to apply a pressing force $F_N$ to the integrated braking surface of said brake device, the brake lining arranged on a front end of one of the brake levers, the brake lining having a counter-shape corresponding to the shape of the integrated brake surface, and the brake lining selectively acting on the integrated brake surface for braking and holding said elevator car when selectively applied by said one brake lever, wherein said brake equipment is arranged at said elevator car, said brake device includes a guide rail that guides said elevator car, and said brake surface is integrated in said guide rail, and wherein said guide rail has a guide region for interaction with guide means and a brake region with said brake surface for interaction with said brake equipment, wherein said guide region and said brake region have different surfaces and said guide region is separated from said brake region.

10. The elevator installation according to claim 9 wherein said guide region has a slide means for reducing friction.

11. The elevator installation according to claim 10 wherein said slide means is formed from a nano-composite material for reducing friction.

12. The elevator installation according to claim 10 wherein said slide means includes a profile member formed from a synthetic material for reducing friction.

13. The elevator installation according to claim 9 wherein said guide rail is T-shaped and has a rail web, said rail web including both said guide region for interaction with the guide means and said brake region for interaction with said brake equipment.

14. The elevator installation according to claim 9 wherein said at least one longitudinal wedge groove is one of a plurality of V-grooves.

15. The elevator installation according to claim 9 wherein said brake surface is recessed in said brake device or wherein said brake surface protrudes from said brake device.

* * * * *